US010039689B1

(12) United States Patent
Hajianpour

(10) Patent No.: US 10,039,689 B1
(45) Date of Patent: Aug. 7, 2018

(54) HAND AND FOOT MASSAGER

(71) Applicant: Zoya Hajianpour, Fort Lauderdale, FL (US)

(72) Inventor: Zoya Hajianpour, Fort Lauderdale, FL (US)

( * ) Notice: Subject to any disclaimer, the term of this patent is extended or adjusted under 35 U.S.C. 154(b) by 1021 days.

(21) Appl. No.: 13/716,186

(22) Filed: Dec. 16, 2012

(51) Int. Cl.
*A61H 15/00* (2006.01)
*A61H 15/02* (2006.01)

(52) U.S. Cl.
CPC ..... *A61H 15/0078* (2013.01); *A61H 15/02* (2013.01); *A61H 2201/164* (2013.01)

(58) Field of Classification Search
CPC ..... A61H 7/002; A61H 7/004; A61H 7/007; A61H 15/00; A61H 15/0078; A61H 15/02; A61H 2015/0007; A61H 2015/0042; A61H 2015/005; A61H 2015/0064; A61H 2015/0071; A61H 2201/1215; A61H 2201/123; A61H 2201/1418; A61H 2201/1436; A61H 2201/1635; A61H 2201/164; A61H 2201/1664; A61H 2201/1669; A61H 2201/1671; A61H 2205/12; A61H 2205/125; A61H 7/001; A61H 7/005
USPC ..... 601/85–87, 89–81, 93–95
See application file for complete search history.

(56) References Cited

U.S. PATENT DOCUMENTS 4,577,625 A 3/1986 Lohati et al.
4,936,292 A * 6/1990 Hidetsugu ..... A61H 39/04 601/104
5,063,911 A 11/1991 Teranishi
5,099,826 A 3/1992 Hayakawa
5,263,474 A 11/1993 Agader
5,305,738 A 4/1994 Shimizu
5,605,533 A * 2/1997 Badilla ..... A61H 15/0078 601/103
6,102,875 A 8/2000 Jones
6,319,215 B1 * 11/2001 Manor ..... A61H 9/0078 601/148
6,494,549 B2 12/2002 Kuo
6,866,776 B2 3/2005 Leason et al.
7,128,711 B2 10/2006 Lev et al.
7,846,113 B2 * 12/2010 Ferber ..... 601/90
8,052,624 B2 * 11/2011 Buchanan ..... A61F 7/00 601/11
2004/0082886 A1 * 4/2004 Timpson ..... A61H 9/0078 601/15
2004/0173220 A1 * 9/2004 Harry ..... A43B 3/0005 128/892
2009/0048547 A1 * 2/2009 Chen ..... A61H 7/001 601/15
2009/0306559 A1 * 12/2009 Tsai ..... A61H 7/007 601/128

(Continued)

*Primary Examiner* — Michael Tsai
(74) *Attorney, Agent, or Firm* — Ronald V. Davidge

(57) ABSTRACT

A device for massaging either a human hand or a human foot includes a number of massage elements formed on a plate that is moved within a carriage adjacently below an opening in a housing. The sole of the foot or the palm of the hand is held in contact with the massage elements or in contact with a flexible sheet extending within the opening by an enclosure. In one version, separate enclosures are provided for the hand and for the foot; in another version, the enclosure is adjustable for use with either a hand or a foot.

9 Claims, 13 Drawing Sheets

(56) References Cited

U.S. PATENT DOCUMENTS

2010/0280426 A1* 11/2010 Tsai ..... A61H 15/0078
601/99
2011/0118637 A1* 5/2011 Lev ..... A61H 23/0254
601/108

* cited by examiner

RELEASE DEPRESSED ?
652
YES
NO
RESET FLAG
654
IN BACKWARD POSITION ?
636
YES
NO
FLAG SET ?
638
YES
NO
IN INTERMEDIATE POSITION ?
648
YES
NO
DRIVE CARRIAGE BACKWARD
640
RELEASE DEPRESSED ?
658
YES
NO
RESET FLAG
660
FORWARD DEPRESSED ?
644
YES
NO
SET DEPRESSED ?
646
YES
NO
642
STOP DEPRESSED ?
648
YES
NO

HAND AND FOOT MASSAGER

RELATED APPLICATIONS

Not Applicable.

FEDERALLY SPONSORED RESEARCH OR DEVELOPMENT

Not Applicable.

FEDERALLY SPONSORED RESEARCH OR DEVELOPMENT

Not Applicable.

BACKGROUND OF THE INVENTION

1. Field of the Invention

This invention relates to an apparatus for messaging the hands and feet.

2. Summary of the Background Information

The patent literature includes a number of massage devices incorporating a plurality of massage elements with spherical surfaces, such as balls that are held within cavities so that the balls are free to rotate, as the are moved along a person's body surface. Such devices range from a simple tray filled with a rectangular array of balls, along which the soles of either or both feet are slid with weight being applied to perform a foot message, through, for example, a device in which a number of wheels, each having a spherical contact surface extending between flattened ends through which an axial hole extends, are driven along a person's skin by a motor moving the axle. Spherical surfaces are used to are used to concentrate the pressure being applied to provide an effective massage without causing discomfort. Massage devices intended for use on multiple or varied body surfaces tend to be either quite large devices, for example that a person can lie under, or, more commonly, small, hand-held devices that require extreme dexterity or another person to be used in some body locations.

SUMMARY OF THE INVENTION

According to a first aspect of the invention, an apparatus is provided for massaging a surface of a human extremity. The apparatus includes a housing, a carriage, a carriage drive mechanism. a massage plate, and a massage plate driving mechanism. The housing in turn includes an upper surface having a housing opening configured to extend around a sole of a human foot. The carriage is mounted to move in longitudinal directions within the housing below the housing opening in either direction between a forward position and a backward position. The carriage drive mechanism moves the carriage longitudinally in either direction between the forward position and the backward position. The massage plate, which is movably mounted within the carriage including an upper surface, has a first plurality of massage elements extending upward adjacent the housing opening. The massage plate driving mechanism moves the massage plate within the carriage so that massage elements within the first plurality are moved longitudinally and in transverse directions perpendicular to the longitudinal direction.

The apparatus may additionally include a flexible sheet held in place within the housing by a frame to extend across the housing opening. The carriage drive mechanism may additionally include a carriage drive motor moving the carriage longitudinally and a location sensing device turning the carriage drive motor off to stop forward motion of the carriage when the carriage has reached the forward position and to stop backward motion of the carriage with the carriage has reached the backward position.

For example, the massage plate is mounted to rotate within the carriage about a vertical axis, with the massage plate driving mechanism moving the massage plate in rotation about the vertical axis. Alternately, the massage plate is mounted to slide within the carriage in the longitudinal and transverse directions, with the massage plate driving mechanism moving the message plate to slide within the carriage in the longitudinal and transverse directions. Such an apparatus additionally may additionally comprise a sliding plate mounted to slide within the carriage in and opposite a first direction, parallel to the housing opening. The massage plate is then mounted to slide on the sliding plate in and opposite a second direction, perpendicular to the first direction and parallel to the housing opening. The massage plate drive mechanism then includes a massage plate drive motor, a drive shaft driven in rotation about a vertical axis, and an eccentric pin, attached to the drive shaft and spaced apart from the vertical axis, with the eccentric pin being mounted to rotate within the massage plate.

For example, the upper surface of the massage plate may include a flat surface having a plurality of sockets extending downward into the massage plate and a plurality of spherical balls, forming the first plurality of massage elements, held to rotate within the sockets while extending upward from the sockets adjacent the housing opening. Alternately, the upper surface of the massage plate may include a first plurality of rounded massage surfaces extending upward adjacent the housing opening, the massage plate optionally additionally including a heating element providing local heating at one or more of the plurality of rounded massage surfaces In a first embodiment, the apparatus additionally includes a pair of rails extending within the housing and a plurality of bushings attached to the carriage, with the carriage being mounted to move longitudinally within the housing by sliding engagement between the bushings and the rails, and with the carriage drive mechanism including a leadscrew, driven in rotation by the carriage drive motor and extending within the housing to drive the carriage between the forward and backward positions; and a nut attached to the carriage, engaging the leadscrew. Alternately the apparatus may include a support surface disposed ender the a portion of the elongated drive structure adjacent the housing window to limit downward deflection of the elongated drive structure; and a plurality of wheels rotatably mounted on the carriage in alignment with the support structure, with the carriage being mounted to move longitudinally by rolling engagement between the wheels and the support surfaces.

In a second embodiment, the carriage drive mechanism includes a front drive structure mounted to rotate about a front transverse axis near a front end of the housing, a rear drive structure mounted to rotate about a rear transverse axis near a rear end of the housing, a flexible elongated drive structure attached to extend between the front and rear ends of the carriage and around the front and rear dive structures, a carriage drive motor driving one of the cylindrical drive structures in rotation, with the flexible elongated drive structure further including a second plurality of massage elements extending upward adjacent the housing opening, with the first and second pluralities of massage elements both being outwardly exposed through the housing opening. The apparatus then additionally includes a support structure disposed ender the a portion of the elongated drive structure adjacent the housing window to limit downward deflection of the elongated drive structure.

In a first version of the second embodiment, each of the cylindrical drive structures comprises a pair of sprockets spaced apart in a transverse direction along an axle, while the flexible drive structure includes a pair of roller chains, each extending around one of the sprockets on the front cylindrical drive structure and one of the sprockets on the rear cylindrical drive structure, with a plurality of pins extending between the pair of roller chains to rotatably mount chain rollers within each of the roller chains and massage rollers disposed between the roller chains to form the second plurality of massage elements. Preferably, the flexible drive structure additionally includes a flexible front drive portion, a flexible rear drive portion, equal in length to the front drive portion, and a rigid spacer, equal in length to a distance between the front and rear ends of the carriage, and each of the flexible drive portions includes a pair of roller chains, each extending around one of the sprockets on the front cylindrical drive structure and one of the sprockets on the rear cylindrical drive structure, with a plurality of pins extending between the pair of roller chains to rotatably mount chain rollers within each of the roller chains and massage rollers disposed between the roller chains to form the second plurality of massage elements.

In a second version of the second embodiment, each of the cylindrical drive structures comprises a cylindrical roller mounted to rotate about a transverse axis, and the flexible drive structure includes a flexible web and the second plurality of massage elements, each extending outward from the flexible web. Preferably, the flexible drive structure additionally includes a flexible front drive portion, a flexible rear drive portion, equal in length to the front drive portion, and a spacing portion, equal in length to a distance between the front and rear ends of the carriage, with the flexible web extending along each of the flexible drive portions and along the spacing portion, and with all the massage elements being disposed along the flexible drive portion.

Preferably, the apparatus additionally includes a first upper cover attached to the housing, configured to form a pocket holding a sole of a human foot adjacent a portion of the housing opening. In one version of the invention, the first upper cover is formed as a flexible strap that can additionally be configured to hold a palm of a hand against a portion of the housing opening. The flexible strap may include a heating element, or it may be used with a sock or mitten including a heating element. In another version of the invention, the first cover encloses the foot, with the apparatus additionally including a second cover configured to form a pocket enclosing a human hand, with a palm of the hand held adjacent the portion of the housing opening.

BRIEF DESCRIPTION OF THE DRAWINGS

Various aspects of the invention will be made apparent by reading the following specification in conjunction with the accompanying figures, in which.

DETAILED DESCRIPTION OF THE INVENTION

Figure 1:
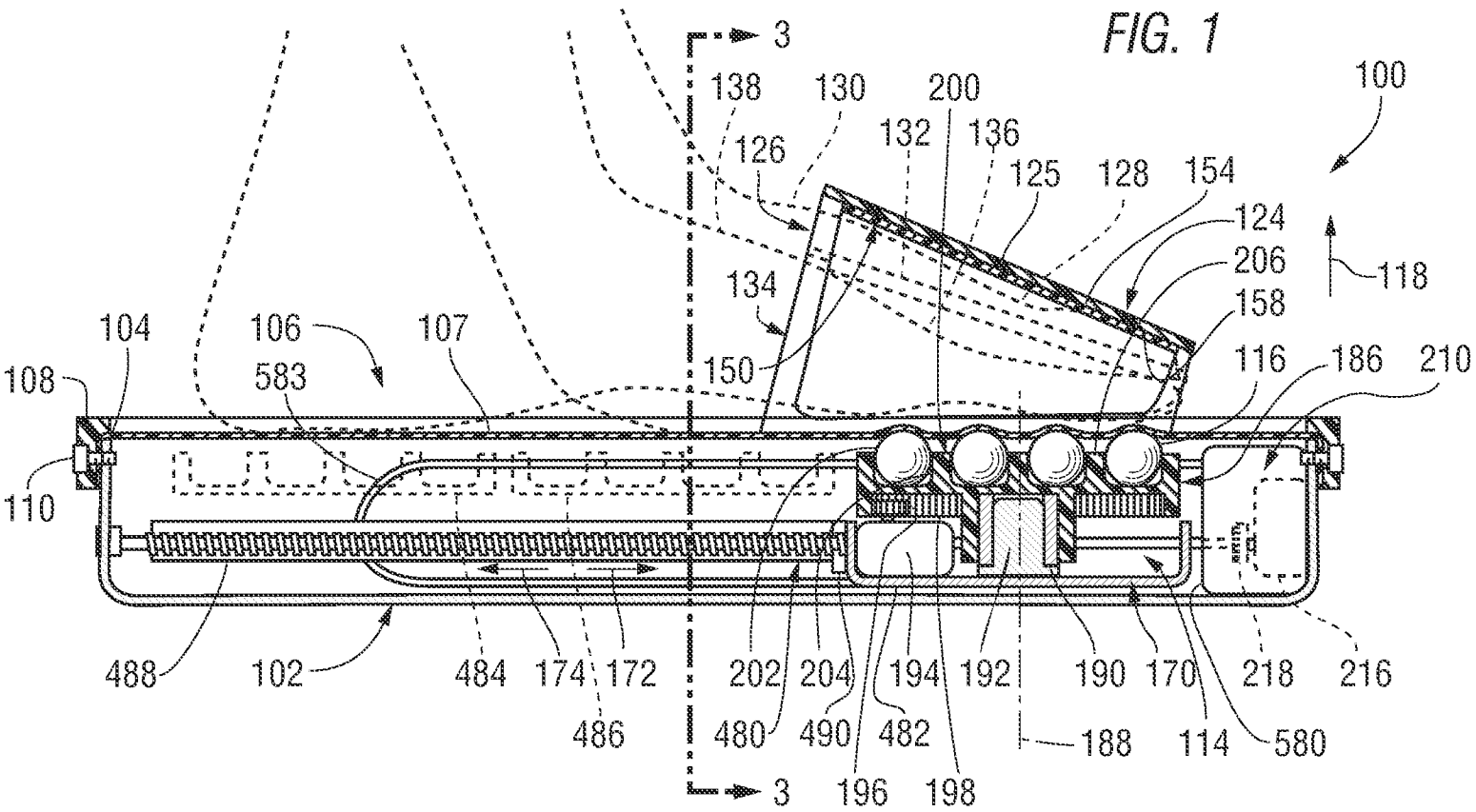
FIG. 1 is a longitudinal cross-sectional elevation of a massage device built in accordance with a first embodiment of the invention.
Figure 3:
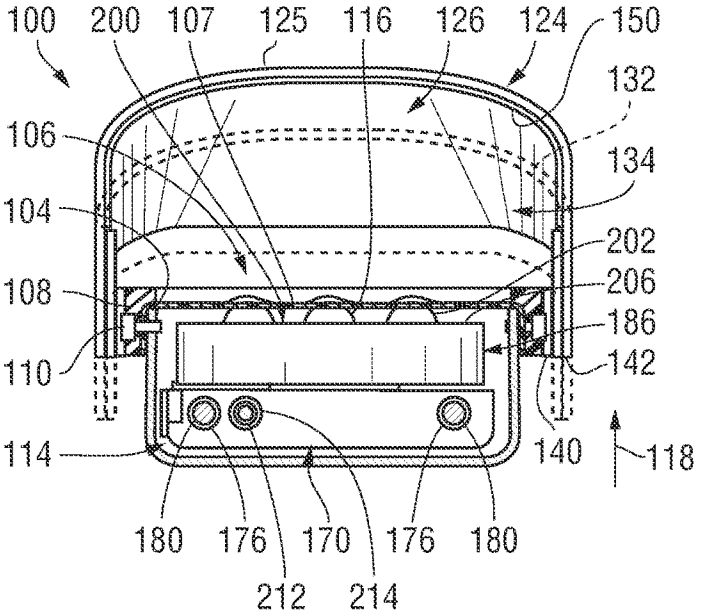
FIG. 3 is a the massage device of FIG. 1, taken as indicated by section lines 3-3 therein.
Figure 2:
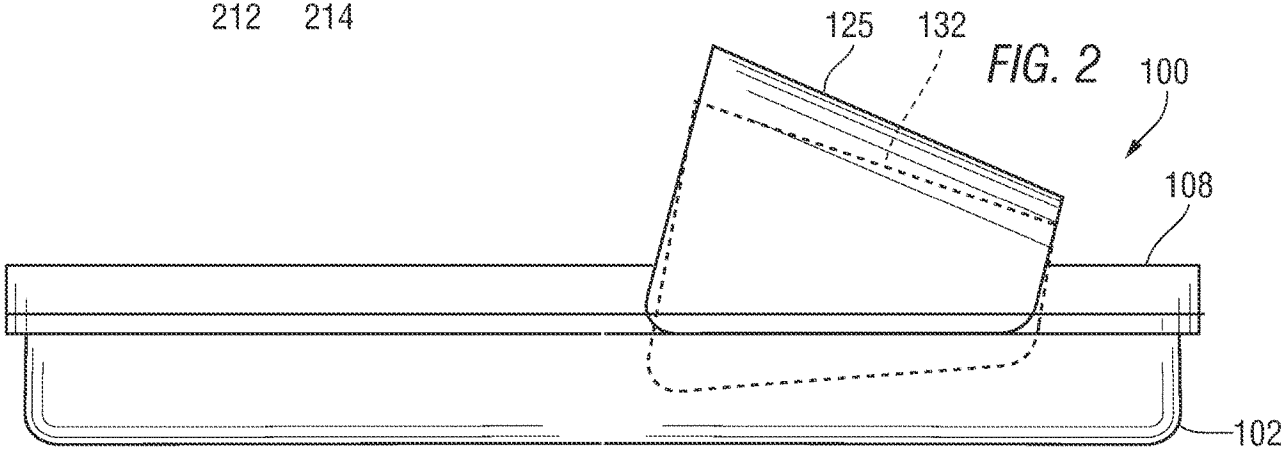
FIG. 2 is a right elevation of the massage device of FIG. 1.

Various aspects of a massage device 100, built in accordance with a first embodiment of the invention, will first be described with reference being made to FIGS. 1-3, of which FIG. 1 is a longitudinal cross-sectional view of the massage device 100, FIG. 2 is a right elevation, showing a front portion of the massage device 100, and FIG. 3 is a transverse elevation thereof, taken as indicated by section lines 3-3 in FIG. 1. The massage device 100 includes a housing 102 having an upper surface 104 with a housing opening 106, across which a flexible sheet 107 is stretched, being held in place by a frame 108 fastened to the housing 102 by a number of screws 110. For example, the flexible sheet 107 is composed of a textile material coated with an elastomeric material to form a sheet having both flexibility regarding bending and a high tensile strength. A massage mechanism 114 within the housing 102 moves a first plurality of massage elements 116, which each extend upwardly, in the direction of arrow 118, adjacent to the housing opening 106, upwardly deflecting the flexible sheet 107.

The massage device 100 additionally includes an upper cover 124, including a flexible strap 125 attached to the housing 102, with the upper cover 124 being configured to form a pocket 126 holding a sole 128 of a human foot 130 adjacent to a portion of the housing opening 106, in contact with the flexible sheet 107. Preferably, the upper cover 124 is adjustably attached to the housing 102, allowing its attachment at a position indicated by dashed lines 132, in which a pocket 134 is formed in a configuration holding a portion 136 of a human hand 138 adjacent to a portion of the housing opening 106, in contact with the flexible sheet 107. For example, the upper cover 124 is adjustably attached to the housing 102 by means of hook and loop fastening pads, sold under the trademark VELCRO, with a pad 140 including a plurality of hooks engaging a pad 142 including a plurality of loops.

Figure 4:
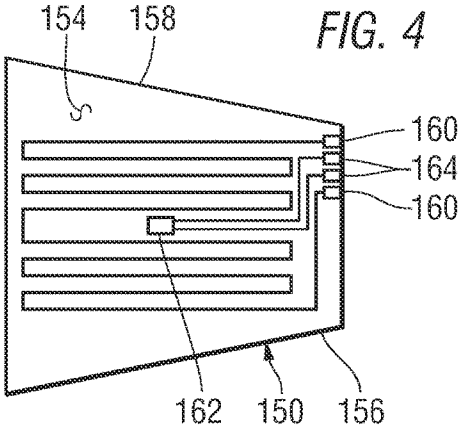
FIG. 4 is a plan view of a heating element within the massage device of FIG. 1.

Preferably, the upper cover 124 additionally includes a heating element 150 that can be used for heating a portion of a human foot or hand being massaged. FIG. 4 is a plan view of an exemplary version of the heating element 150, which includes an electrically conductive path 152 extending along an upper surface 154 of a flexible, electrically insulating substrate 156. The upper surface 154 is adhesively attached to a lower surface 158 of the flexible strap 124. While the heating element 150 is shown in a flattened condition in FIG. 4, the flexibility of the insulating substrate 156 preferably provides conformance with the shape of the flexible strap 124, as shown in FIG. 3. The electrically conductive path 152 has sufficient electrical resistance to generate heat when a suitable electrical current is driven between its terminals 160. The heating element 150 may additionally include a thermal sensor 162, producing an electrical signal present at its terminals 164.

Figure 5:
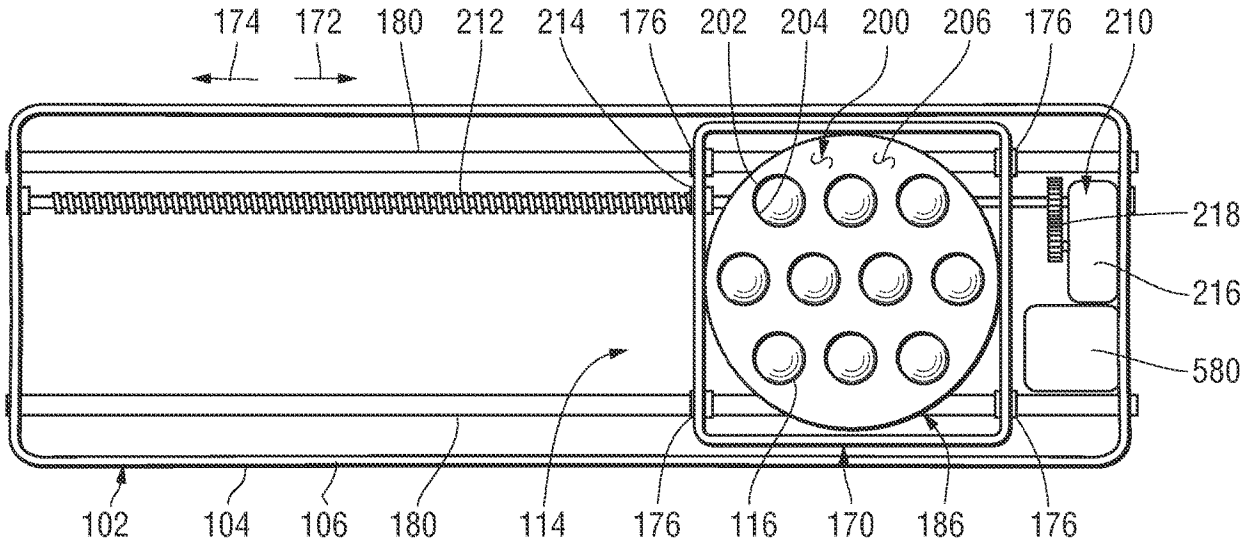
FIG. 5 is a plan view of a housing within the massage device of FIG. 1.

The message mechanism 114 will now be discussed, with continuing reference being made to FIGS. 1 and 3, and with additional reference being made to FIG. 5, which is a plan view of the housing 102, shown with the flexible cover 107 and the frame 108 removed to reveal the massage mechanism 114. The message mechanism 114 includes a carriage 170, which is mounted to move longitudinally, in a forward direction of arrow 172 and in a backward direction of arrow 174 below the housing opening 106, with a number of bushings 176 within the carriage 170 sliding along parallel rails 180 held within the housing 102. A massage plate 186 is held within the carriage 170 to rotate about a vertical axis 188, with a bearing 190 within the massage plate 186 turning on a shaft 192 within the carriage 170, and with a massage plate drive motor 194 driving the massage plate 186 in rotation through a motor gear 196 engaging an internal massage plate gear surface 198. The massage plate 186 includes an upper surface 200, which includes the massage elements 116. For example, each of the massage elements 116 includes a spherical ball 202 held to rotate within a socket 204 extending downward from a flat surface 206 of the massage plate 186. The massage mechanism 114 additionally includes a carriage drive mechanism 210 driving the carriage 170 in the forward direction of arrow 172 and in the backward direction of arrow 174 by means of a leadscrew 212 engaging a nut 214 attached to the carriage 170. A carriage drive motor 214 drives the leadscrew 212 in rotation through a gear train 216.

Figure 6:
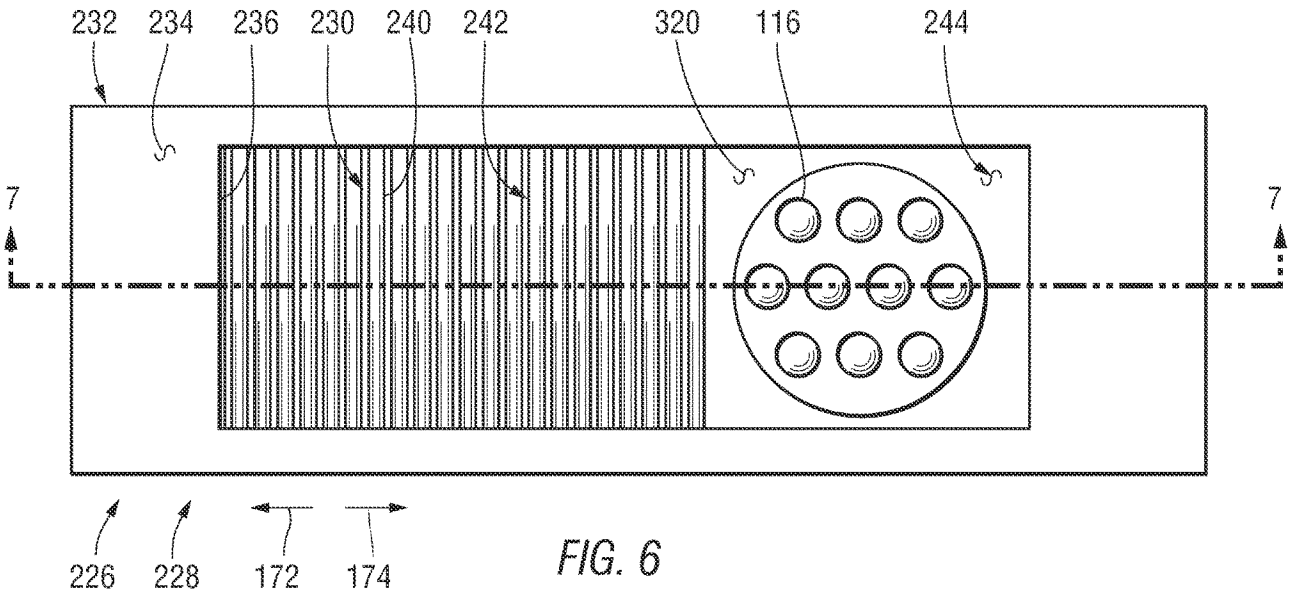
FIG. 6 is a plan view of a housing within a massage device built in accordance with a first version of a second embodiment of the invention.
Figure 7:
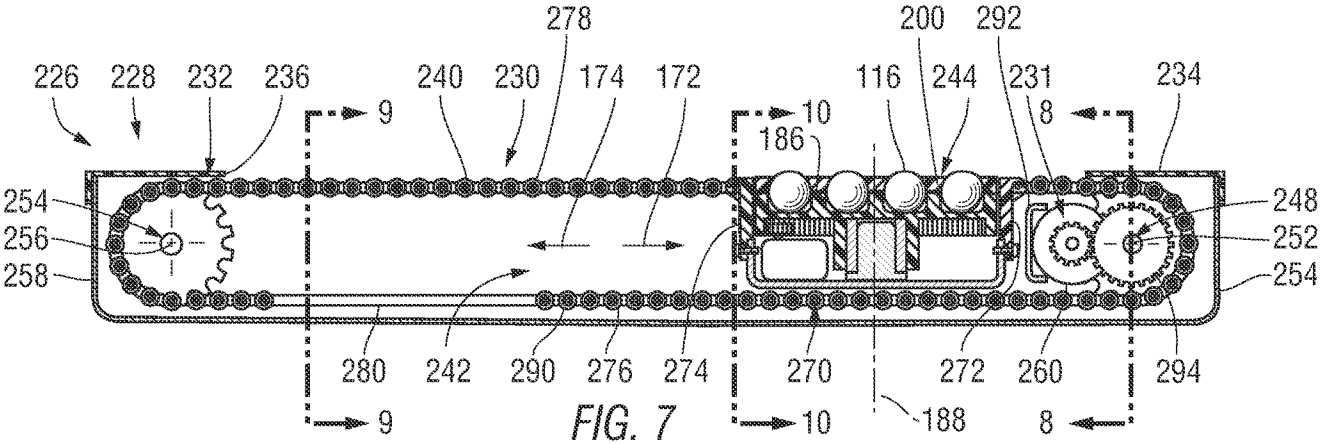
FIG. 7 is a longitudinal cross-sectional elevation of the housing of FIG. 6, taken as indicated by section lines 7-7 therein.
Figure 8:
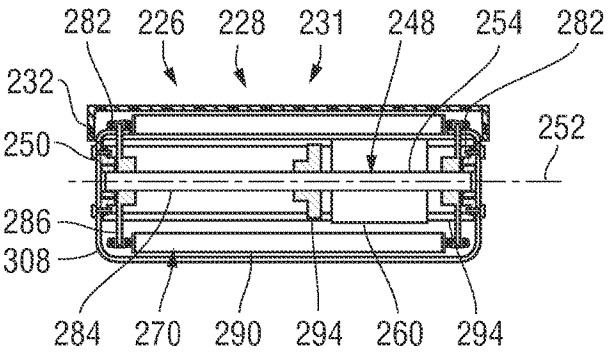
FIG. 8 is a transverse cross-sectional elevation of the housing of FIG. 6, taken as indicated by section lines 8-8 in FIG. 7 to show a carriage drive mechanism therein.

Various aspects of a massage device 226, built accordance with a first version of a second embodiment of the invention will now be described with reference being made to FIGS. 6-8, of which FIG. 6 is a plan view of a housing 228 within the message device 226, showing elements held therein, while FIG. 7 is a longitudinal cross-sectional elevation of the housing 228, taken as indicated by section lines 7-7 in FIG. 6 to show a massage mechanism 230 held therein, and while FIG. 8 is a transverse cross-sectional view of the housing 228, taken as indicated by section lines 8-8 in FIG. 7 to show a carriage drive mechanism 231.

The housing 228 includes a cover 232 having an upper surface 234 with an opening 236, upwardly exposing a first plurality of massage elements 116 and a second plurality of massage elements 240. With elements similar to those within the massage device 100 built in accordance with the first embodiment of the invention and described above in reference to FIGS. 1-5, it is noted that the housing 228 holds a massage mechanism 242 including a carriage 244 which is mounted to move longitudinally, in the forward direction of arrow 172 and in the backward direction of arrow 174 below the housing opening 236, and that the massage elements 116 within the first plurality are disposed along the upper surface 200 of a massage plate 186 that is configured and driven in rotation about a vertical axis 188 as described above in reference to FIGS. 1-5.

In accordance with the second embodiment of the invention, the carriage drive mechanism 231 includes a front drive structure 248, mounted to rotate within bearing blocks 250 about a transverse axis 252 near the front end 254 of the housing 228, and a rear drive structure 254, similarly mounted to rotate about a transverse axis 256 near the rear end 258 of the housing 225, with one of the drive structures 248, 254 being driven in rotation by a carriage drive motor 260. The carriage drive mechanism 231 additionally includes a flexible drive structure 270, attached to extend between a front end 272 of the carriage 244 and a rear end 274 thereof, extending around the front drive structure 248 and the rear drive structure 254. The flexible drive structure 270 includes the second plurality of massage elements 240, which extend upward, adjacent to the housing opening 236. Preferably, the flexible drive structure 270 includes a flexible front drive portion 276, a flexible rear drive portion 278, which is equal in length to the front drive portion 276, and a spacer 280 that is equal in length to a distance between the front end 272 and the rear end 274 of the carriage 244, with the massage elements 240 being disposed along only along the flexible front drive portion 276 and the flexible rear drive portion 278, providing massage elements 240 along a portion of the flexible drive structure that is adjacent to the housing opening 236 as the carriage 244 is moved within the housing 228 while eliminating a cost associated with providing the massage elements 240 within the spacer 280.

In a first version of the second embodiment, as shown in FIGS. 6-8, the flexible drive structure 270 includes a pair of roller chains 282, while the front drive structure 248 and the rear drive structures 254 each include a shaft 284 and a pair of sprockets 286 engaged by the roller chains 282. The flexible drive structure 270 moves the carriage 244 in the directions of arrows 172, 174 and additionally provides the second plurality of massage elements 240 in the form of massaging rollers 290. The carriage drive mechanism 246 further includes a carriage drive motor 260, fastened to a transverse support channel 294 within the housing 232, with the carriage drive motor 260 being arranged to drive the front drive structure 248 through gears 294.

Figure 9:
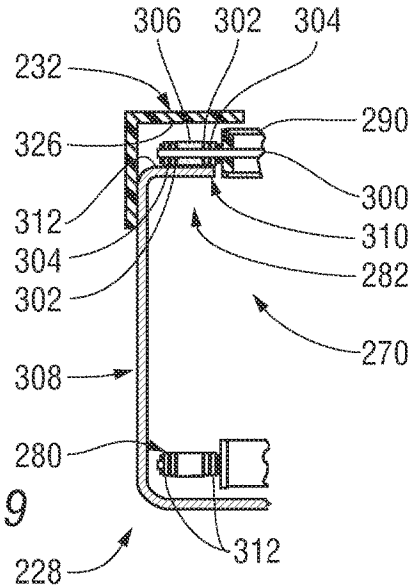
FIG. 9 is a fragmentary transverse cross-sectional elevation of the housing of FIG. 6, taken as indicated by section lines 9-9 in FIG. 7 to show the construction of a drive chain therein.

FIG. 9 is a fragmentary transverse cross-sectional elevation of the housing 228, taken as indicated by section lines 9-9 in FIG. 7 to show the construction of the flexible drive structure 270 therein, which includes a plurality of drive pins 300, each extending within and between the two roller chains 282, and each rotatably mounting one of the massaging rollers 290. Within each of the roller chains 282, each drive pin 300 additionally rotationally mounts a pair of inner links 302, which extend in the direction of arrow 172 to the next drive pin 300, a pair of outer links 304, which extend in the direction of arrow 174 to another drive pin 300, and a roller 306, which is configured to engage the sprockets 286. Preferably, the housing 228 includes a framework 308 with flanges 310 providing a support surface 312 disposed under the chain rollers 306 to limit downward deflection of the flexible drive structure 270 due to the application of massaging forces. The spacer 280 includes a pair of extended outer links 314, which are rigid, since are only moved between, not around, the drive structures 248, 254.

Figure 10:
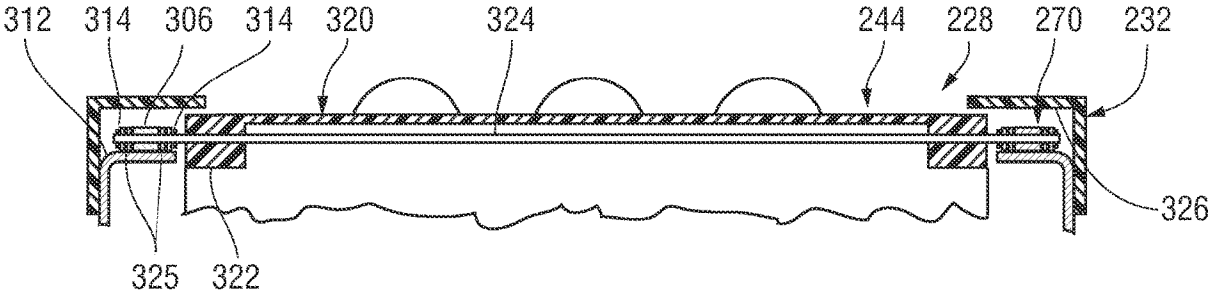
FIG. 10 is a fragmentary transverse cross-sectional elevation of the housing of FIG. 6, taken as indicated by section lines 10-10 in FIG. 7 to show the attachment of the drive chain to a carriage therein.

FIG. 10 is a fragmentary transverse cross-sectional elevation of the housing 228, taken as indicated by section lines 9-9 in FIG. 7 to show the attachment of the carriage 244 to an end of the carriage 244 to an end of the flexible drive structure 270. The carriage 244 includes a bezel 320, extending around the massage plate 186 (shown in FIG. 7) and having a pin attachment block 322 at each corner, through which an attachment pin 324 extends, attaching the carriage to outer links 314 in the flexible drive structure 270. A pair of rollers 306 are rotatably mounted between spacing washers 325 on each of the attachment pins 324, serving as wheels mounting the carriage 244 to move in the longitudinal directions of arrows 172, 174 with the rollers 306 in rolling contact with the support surface 312. It is further noted that contact between an inner surface 326 of the cover 232 and the bezel 320 limits the movement of the rollers 306 away from the support surface 312.

Figure 13:
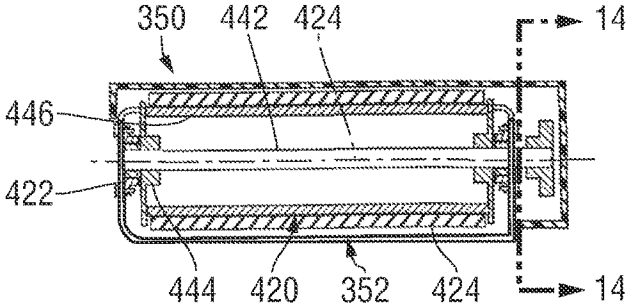
FIG. 13 is transverse cross-sectional elevation of the housing of FIG. 11, taken as indicated by section line 13-13 therein.
Figure 14:
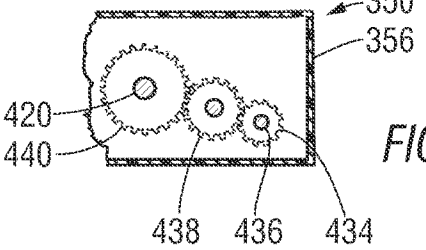
FIG. 14 fragmentary longitudinal cross-sectional elevation of the housing of FIG. 11, taken as indicated by section line 14-14 in FIG. 13.
Figure 15:
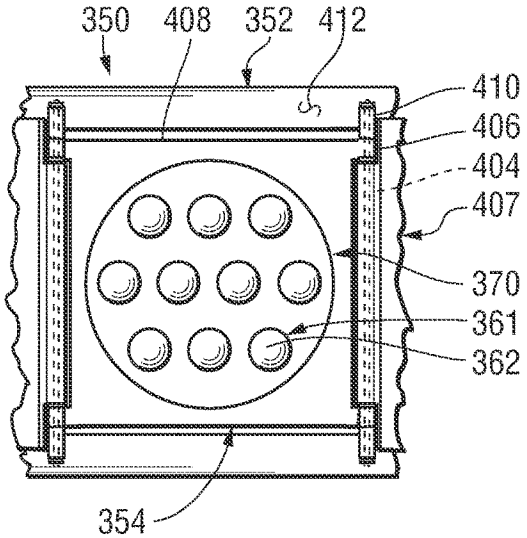
FIG. 15 is a fragmentary plan view of the housing of FIG. 11, showing a carriage therein.

Various aspects of a massage device 350, built accordance with a second version of the second embodiment of the invention will now be described with reference being made to FIGS. 11-15, with FIG. 11 being a longitudinal elevation of a housing 352 within the message device 350. FIGS. 12 and 13 are transverse cross-sectional elevations of the housing 352, with FIG. 12 being taken as indicated by section line 12-12 in FIG. 11, and with FIG. 13 being taken as indicated by section line 13-13 in FIG. 11. FIG. 14 is a fragmentary longitudinal cross-sectional elevation of the housing 352, taken as indicated by section line 14-14 in FIG. 13. FIG. 15 is a fragmentary plan view of the housing 352, showing a carriage 354 therein.

Figure 11:
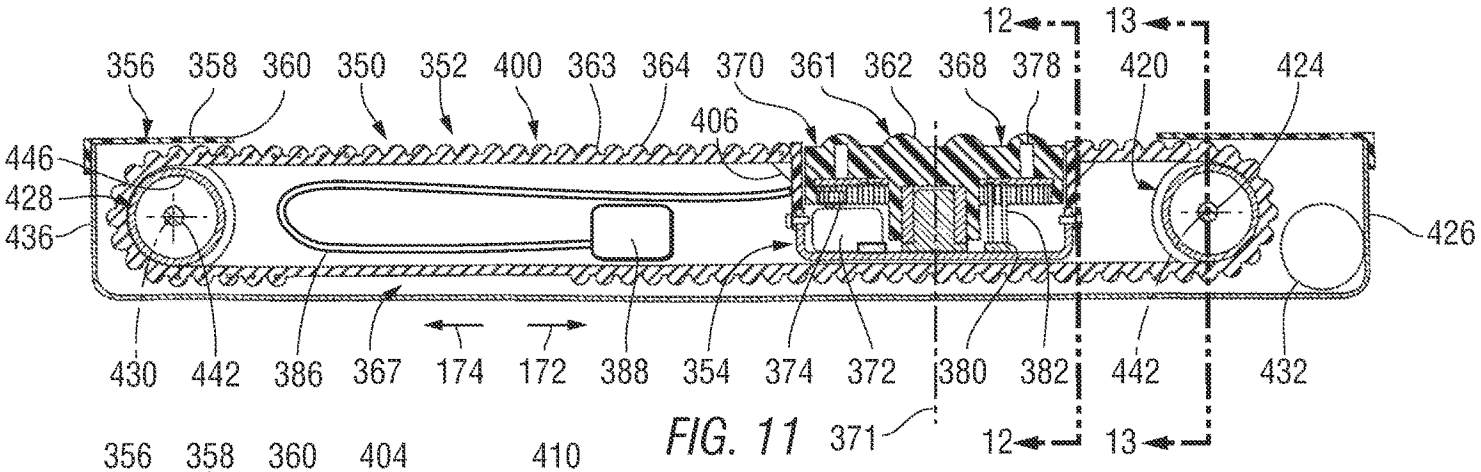
FIG. 11 is a longitudinal cross-sectional elevation of a housing within a message device built in accordance with a second version of the second embodiment of the invention.
Figure 12:
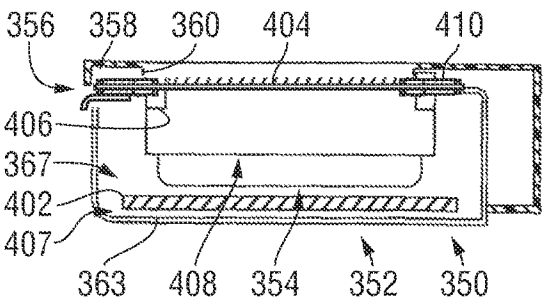
FIG. 12 is transverse cross-sectional elevation of the housing of FIG. 11, taken as indicated by section line 12-12 therein.

Referring to FIG. 11, the housing 352 includes a housing cover 356 having an upper surface 358 with an opening 360, upwardly exposing a first plurality of massage elements 361, each of which extends upward to a spherically rounded massage surface 362, and a second plurality of massage elements 363, each of which each of which extends upward to a cylindrically rounded cylindrically rounded surface 364. The housing 352 holds a massage mechanism 366 including the carriage 354, which is mounted to move longitudinally, in the forward direction of arrow 172 and in the backward direction of arrow 174 below the housing opening 360, being driven in these directions 172, 174 by a carriage drive mechanism 367. The massage elements 361 within the first plurality are disposed along the upper surface 368 of a massage plate 370 that is driven in rotation about a vertical axis 371 by a massage plate drive motor 372 through a drive gear 374 engaging an internal gear surface 376 of the massage plate 370. In the example of FIG. 11, the massage plate 370 additionally includes a number of heating elements 378 providing heat to the rounded massage surfaces 362 of massage elements 361. Each of the heating elements 378 is electrically connected to a pair of contact rings 380 extending along the massage plate 370 to move in contact with a pair of contact springs 382. Both the contact springs 382 and the massage plate drive motor 372 are electrically connected to a power source 384 through a flexible cable 386 extending to a power source 388.

Continuing to refer to FIG. 11, and referring additionally to FIGS. 12 and 15, the carriage drive mechanism 367 comprises a flexible drive structure 400, which is preferably formed as an integral structure, including a flexible web 402 and the massage elements 363 extending outward from the flexible web 402. The flexible drive structure 400 is attached to extend in each direction 172, 174 from the carriage 354 by a pair of attachment pins 404 extending transversely through the flexible drive structure 400 and through a pair of corner brackets 406 at corners of a bezel 408 extending around the massage plate 370 within the carriage 354. Each of the attachment pins 404 additionally mounts a pair of wheels 410 rolling along support surfaces 412 of the housing 352.

Referring additionally to FIGS. 13 and 14, the carriage drive mechanism 367 additionally comprises a front drive structure 420, mounted to rotate within bearing blocks 422 about a transverse axis 424 near the front end 426 of the housing 352, and a rear drive structure 428, similarly mounted to rotate about a transverse axis 430 near the rear end 432 of the housing 352. The front drive structure 420 is driven in rotation by a carriage drive motor 432 through a drive gear 434, attached to a shaft 436 extending from the carriage drive motor 422 to engage an intermediate gear 438, which in turn engages a driven gear 440 attached to the front drive structure 420. Each of the drive structures 420, 428 include a shaft 442, a pair of hubs 444 attached to the shaft 442, and a cylindrical roller 446 extending between the hubs 444 to engage an internal surface 448 of the flexible drive structure 400. Flanges 450 of the hubs 444 additionally guide the flexible drive structure 400.

It is understood that the housing built in accordance with the second embodiment of the invention and the housing built in accordance with the third embodiment of the invention are each readily used with the cover 124 and with the heating element described above in reference to FIGS. 1 and 3, to hold a hand or foot in either of the message devices, and to provide heating as previously described.

Referring again to FIGS. 1 and 3, the massage device 100 built in accordance with the first embodiment of the invention preferably additionally includes a position sensing device 480 that is used to provide for movement of the carriage 170 in either direction between a forwardmost position 482, in which it is shown within FIG. 1, and either a backwardmost position 484 or an intermediate position 486. For example, the intermediate position 486 may be set in correspondence with the length of a foot or hand being messaged and may further facilitate changes needed to support the use of the message device 100 on both hands and feet. For example, the position sensing device 480 includes a target 488 extending along the housing and a sensor 490 attached to the carriage to move along the target 488, with the target 488 including optically or magnetically readable indicia sensed by the sensor 490 to provide data indicating the position of the carriage 170.

Figure 16:
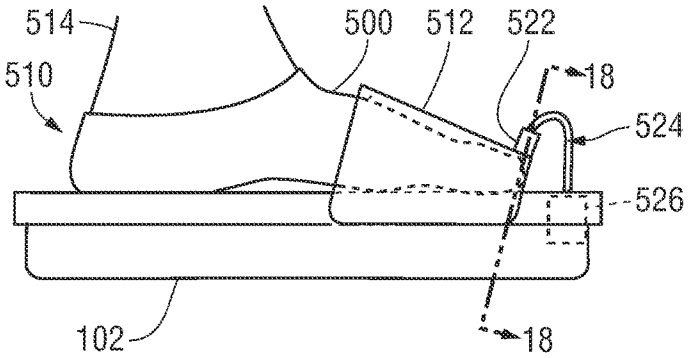
FIG. 16 is a side elevation of a massage device, including the housing of FIG. 5, configured to provide heat through a heated sock.
Figure 17:
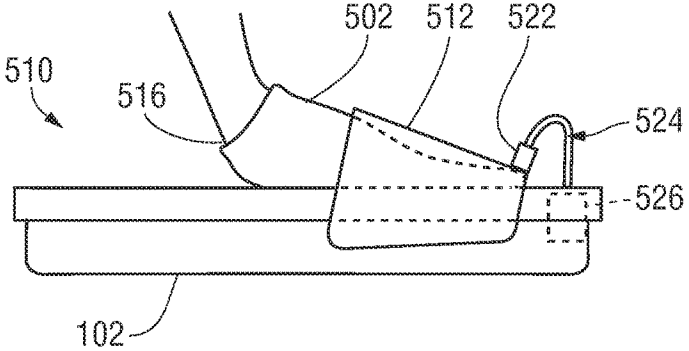
FIG. 17 is a side elevation of the massage device of FIG. 16, equipped with a heated mitten.
Figure 18:
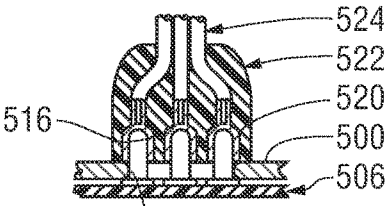
FIG. 18 is a fragmentary cross-sectional view of the massage device of FIG. 16, taken as indicated by section lines 16-16 therein.

An alternative method for providing localized heating with the massage process will now be discussed, with reference being made to FIGS. 16-18, which show heat being provided through an electrically heated sock 500 or through an electrically heated mitten 502. FIG. 16 is a side elevation of the housing 102 built in accordance with the first embodiment of the invention being used to provide a foot message with the electrically heated sock 500, while FIG. 17 is a side elevation of the housing 102 being used to provide a hand message using the heated mitten 502. FIG. 18 is a cross-sectional elevation taken as indicated by section lines 18-18 in FIG. 16 to show a plug 504 electrically connect a heating element 506 within the sock 500 and the mitten 502 with a heat controlling circuit 508. For example, the heating element 506 is similar to the heating element 150 described above in reference to FIG. 4.

Referring first to FIG. 16, an alternative massage device 510 includes a housing built as described above in reference to FIGS. 1-3, an upper support member 512 configured to extend around a foot 514, and the heated sock 500, which includes the heating element 506. As shown in FIG. 17, the alternative massage device 510 can additionally be provided with an electrically heated mitten 502, additionally including the heating element 506 to extend around a hand 516. As shown in FIG. 18, the heating element 506 includes a number of pins 516 individually connected to conductive traces (not shown) within the heating element 506, with the pins 516 removably engaging contact receptacles 520 within a connector 522 which is in turn formed as a part of a heater attachment cable 524 extending from a heater control circuit 526 within the housing 102. The pins 516 extend through a hole 528 within the sock 500. This attachment means holds the heating element 506 in place within the sock 500 as the cable 524 is removed from the heating element 506, while allowing the removal of the heating element 506 from the sock 500 so that the sock 500 can be washed. Another heating element 506 is similarly attached within the heated mitten 502.

While the heated sock 500 and heated mitten 502 have been described as being used with a housing 102 built in accordance with the first embodiment of the invention, it is understood that these elements 500, 502 can be readily used with a housing built in accordance with the third embodiment of the invention.

Figure 19:
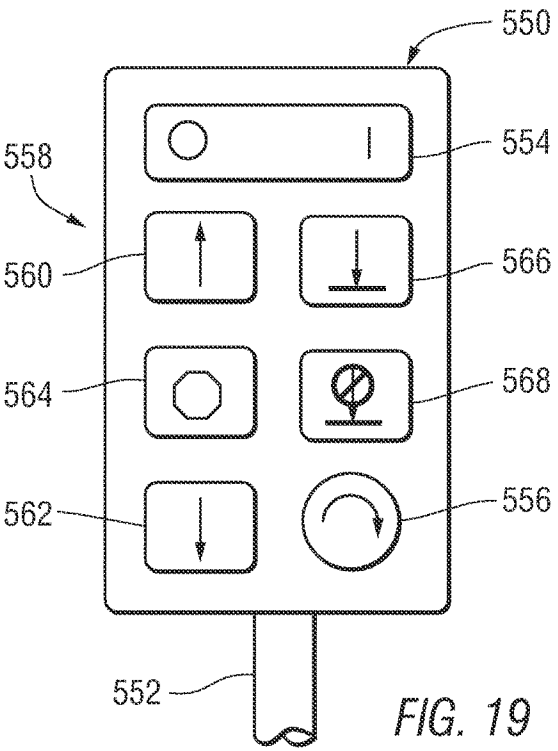
FIG. 19 is an elevation of a hand-held input device attached to the housing of FIG. 5.

FIG. 19 is an elevation of a hand-held input device 550, which is attached to the housing of the message device 100 by a cable 552, which serves as a tether and as a method for carrying electrical signals. The input device 550 includes a power switch 554, which turns electrical power off and on for the massage device 100, a heater control knob 556, which turns the heater unit off and on, and which sets a desired temperature level, and a number of carriage control buttons 558, which are depressed to control the movement of the carriage. For example, the heater control knob 556 is connected to a potentiometer used to set the desired temperature and to an electrical contact, which turns off power to the heater unit when the knob 556 is turned all the way to the left, while each of the carriage control buttons 558 operates an electrical contact to indicate that the button 558 is being depressed. The carriage control buttons 558 include a FORWARD button 560, which is depressed to begin movement of the carriage in the forward direction of arrow, a BACKWARD button 562, which is depressed to begin backward movement of the carriage, in the direction of arrow, a STOP button, 564, which is used to stop movement of the carriage at the location it is in when the STOP button 564 is depressed, a SET button 566, which is used to cause the intermediate position 486 to be set at the location of the carriage when the SET button 566 is depressed, and a RESET button 568, which cancels the intermediate position 486 that has been previously set, allowing the carriage 170 to be driven to the backwardmost position 484 and allowing a new intermediate position 486 to be set.

Figure 20:
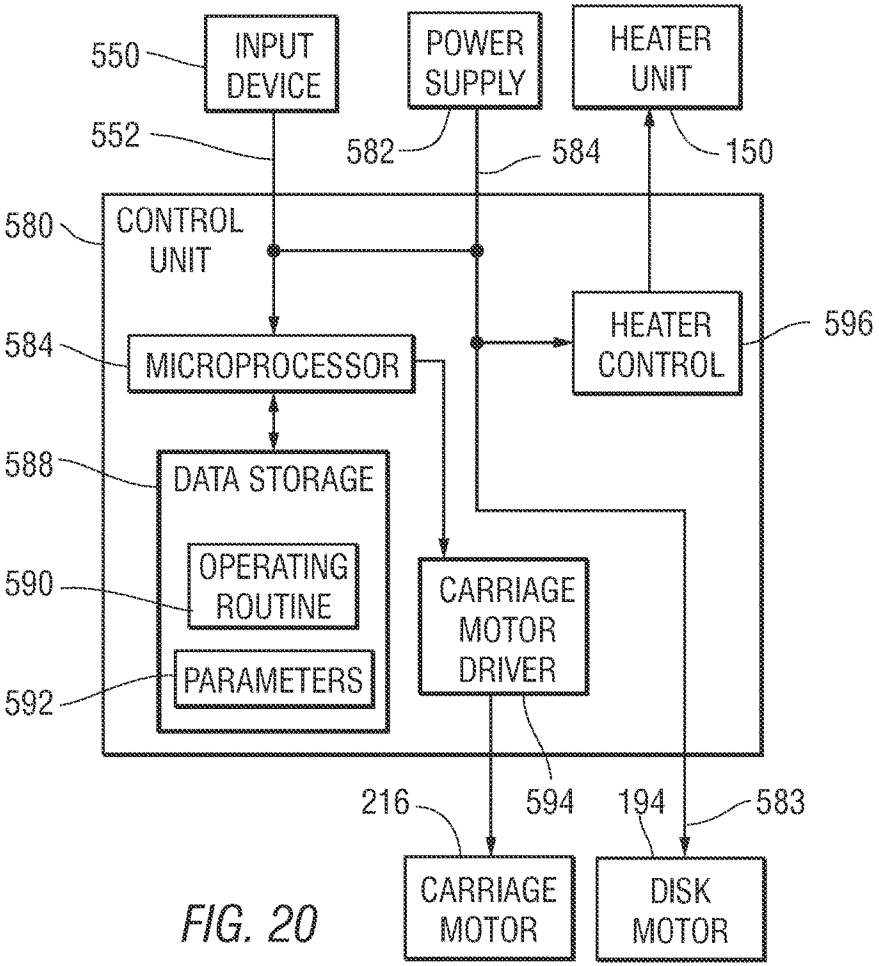
FIG. 20 is a block diagram showing functional elements of the massage device of FIG. 1.

FIG. 20 is a block diagram showing functional elements of the massage device 100. Referring to FIG. 20 and additionally referring again to FIG. 1, it is seen that the housing 102 includes a control unit 580 electrically connected to the input device 550 through the cable 552, and to a power supply 582 through a power cord 584. The power supply 582 is configured to be plugged into a wall socket to receive electrical power. The carriage 170 includes the massage plate drive motor 194, which is attached to the control unit 580 through a flexible cable 583. The control unit 580 includes a microprocessor 584 and data storage 588, which stores a routine 590 storing instructions defining a process for moving the carriage in response to user inputs provided through the input device 550, and parameters storage 592 storing data developed during the execution of the routine 590. Input signals to the microprocessor 584 are also provided from the sensor 490, indicating the position of the carriage 170. The microprocessor 584 provides signals causing a motor drive circuit 594 to drive the carriage drive motor 216 in either direction. The heating element 150 is connected to a heater control circuit 596 within the control unit 580, which is in turn electrically connected to a sensor (not shown) attached to the heater control knob 556 within the input device 550.

Normal operation of the massage device 100 includes driving the carriage 170 in the forward direction of arrow 172 until the forwardmost position 482, in which the carriage 170 is shown, is reached, with the carriage 170 then being stopped and held for a predetermined period of time. Then the carriage 170 is moved in the backward direction of arrow 174 until the intermediate position 486 is reached, if an intermediate position 486 has been set, or into the backwardmost position 488 if the intermediate position 486 has not been set. Then, in either case, the carriage 170 is again driven in the forward direction of arrow 172, with the process being repeated as long as the massage device 100 is turned on.

Figure 21:
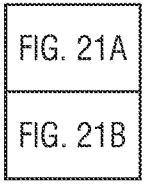
FIG. 21 is a flow chart showing steps within the massage device of FIG. 1.
Figure 21A:
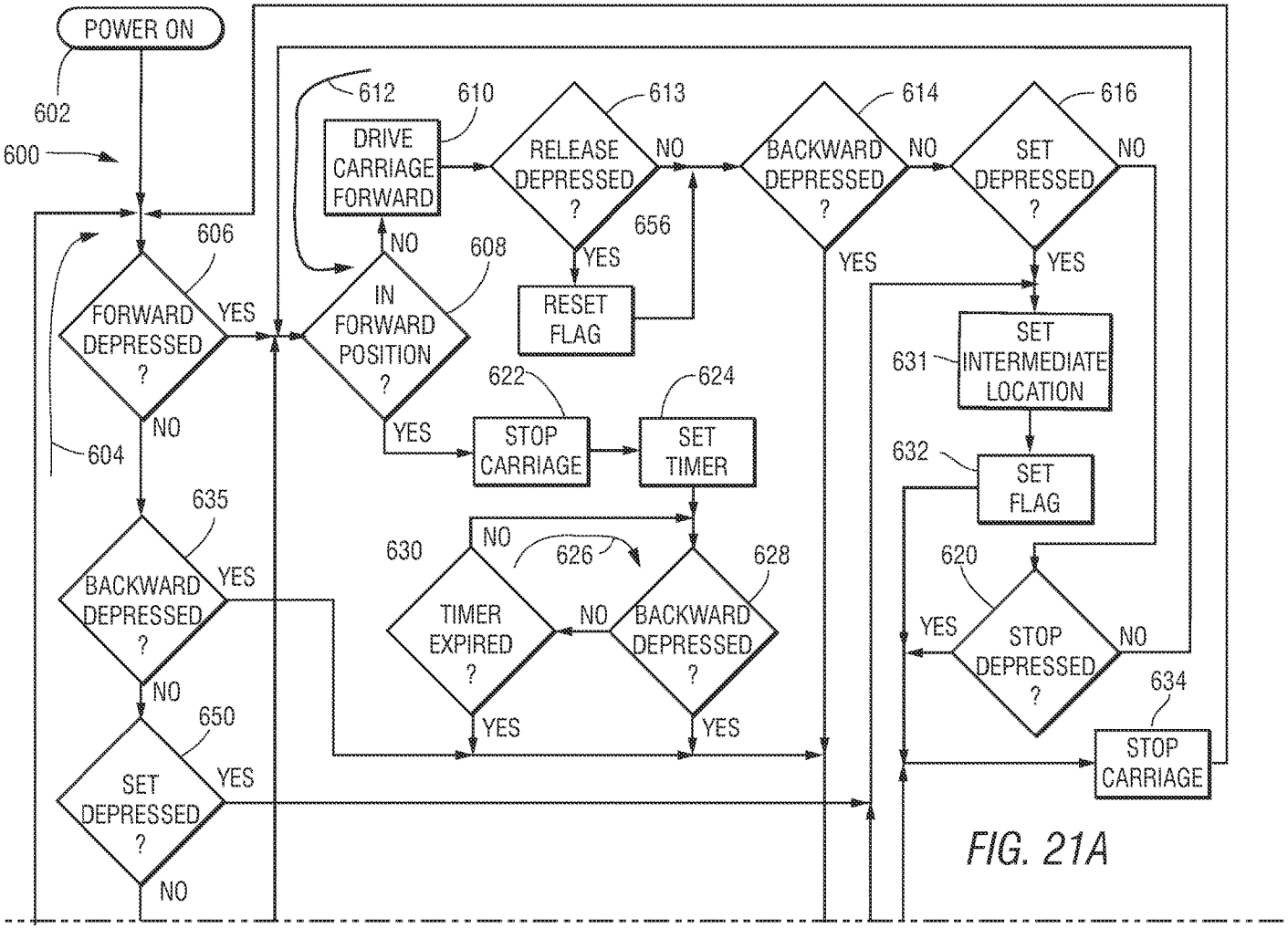
FIG. 21A is an upper portion of the flow chart of FIG. 21.
Figure 21B:
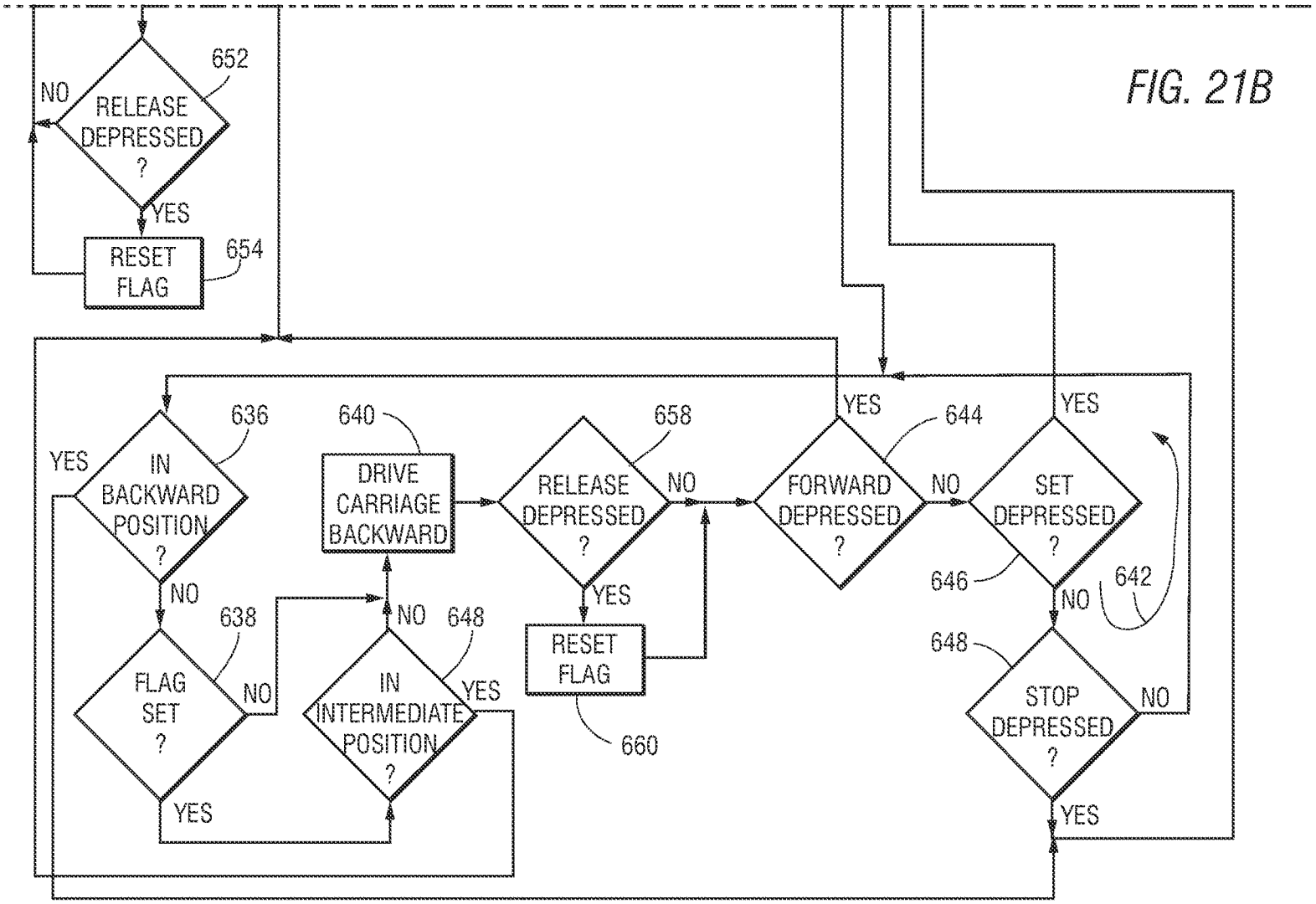
FIG. 21B is a lower portion of the flow chart of FIG. 21.

FIG. 21 is a flow chart showing steps within a process 600 occurring during the execution of the routine 590 within the microprocessor 584. FIG. 21 is divided into an upper portion, identified as FIG. 21A, and a lower portion, identified as FIG. 21B. The process 600 is configured both for providing normal operation of the massage device 100, as described in the preceding paragraph, and for providing modification to such operation in response to the depression of the carriage control buttons 558. This process 600 begins in step 602 when power to the microprocessor 584 is turned on using the power switch 554, causing the routine 600 to enter a loop 604 to determine when one of the carriage control buttons 558 has been depressed.

During operation of the process 600 in the initialization loop 604, when it is determined in step 606 that the FORWARD button 520 is being depressed, a further determination is made in step 608 of whether the carriage is in the forwardmost position 482, in which it is shown in FIG. 1. If it is not, the carriage drive motor 216 is turned on in step 610 to drive the carriage 170 in the forward direction of arrow 172, as the process **6*oo* enters a forward driving loop 612 to continue driving the carriage in the forward direction as long as it is determined in step 608 that the carriage has not been driven into the forwardmost position 482, as long as it is additionally determined in step 614 that the BACKWARD button 562 is not being depressed, as long as it is additionally determined in step 616 that the SET button 566 is not being depressed, as long as it is additionally determined in step 618 that the STOP button 564 is not being depressed, and additionally as long as is additionally determined in step 608 that that the carriage has not been driven into the forwardmost location 482, in which it is shown in FIG. 1**.

On the other hand, when it is determined in step 608 that the carriage has been driven into the forwardmost position 482, in which it is shown in FIG. 1, further movement of the carriage 170 is stopped in step 622, and a timer is set in step 624. For example the timer may be a pulse counting subroutine executing within the microprocessor 584 or an electronic circuit. In either case, after the timer is set in step 624, the process 600 enters a position holding loop 626, with the carriage remaining in the forwardmost position 482 as long as it is determined in step 628 that the BACKWARD button 562 is not being depresses, and as long as it is additionally determined in step 630 that the timer has not expired.

The SET button 566 may be depressed as the carriage 107 is moving forward to set the location of the carriage 107 as the intermediate position 486. Thus, when it is determined in step 616 that the SET button 566 is being depressed, the position of the carriage 170 is set as the intermediate position 486 in step 630, with a set flag bit being set in step 632 to indicate that the intermediate position 486 has been set, and with the carriage being stopped in step 634. The process 600 returns to loop 604 to wait for a carriage control button 558 to be depressed to indicate the next action chosen.

When it is determined, in step 628, in step 614, or in step 636 during operation in the loop 604, that the BACKWARD button 562 is being depressed, or alternately when it is determined in step 630 that the timer has expired, an additional determination is made in step 636 of whether the carriage is in the backwardmost position 484. If it is not, and if it is then determined in step 638 that an intermediate location flag bit has not been set to indicate that backward movement of the carriage is to be stopped at the intermediate position, the carriage is driven backward in step 640, as the process 600 enters a loop 642 to move the carriage backward. in the direction of arrow 174. This movement continues as long as it is determined in step 644 that the forward button has not been depressed, as long it is additionally determined in step 646 that the SET button 566 is not being depressed, as long as it is additionally determined in step 648 that the STOP button is not being depressed, as long as it is determined in step 636 that the backwardmost position has not been reached or in step 648 that the intermediate position has not been reached with the flag bit set.

When it is determined in step 646, or in step 650 during operation in the loop 605, that the SET button 566 is being depressed, the process 600 returns to step 630 to begin the process of setting the intermediate position 486. After the intermediate position 486 has been set, it can be reset at any time by depressing the RESET button 568, allowing the carriage 170 to move past the intermediate position 486 and allowing a new intermediate position 486 to be set. Thus, when it is determined in step 652 during operation in loop 604, that the RESET button 568 is being depressed, the flag bit is reset in step 654; when it is determined in step 613 during operation in loop 612, that the RESET button 568 is being depressed, the flag bit is reset in step 656; and, when it is determined in step 658, during operation in loop 642, that the RESET button is being depressed, the flag vit is rfeset in step 660. Similarly, the forward or backward motion of the carriage 170 can be stopped at any time. Thus, when it is determined in step 620 during forward movement of the carriage 170, or in step 648 during backward movement of the carriage 170, that the STOP button 564 is being depressed, the carriage movement is stopped in step 634.

Figure 22:
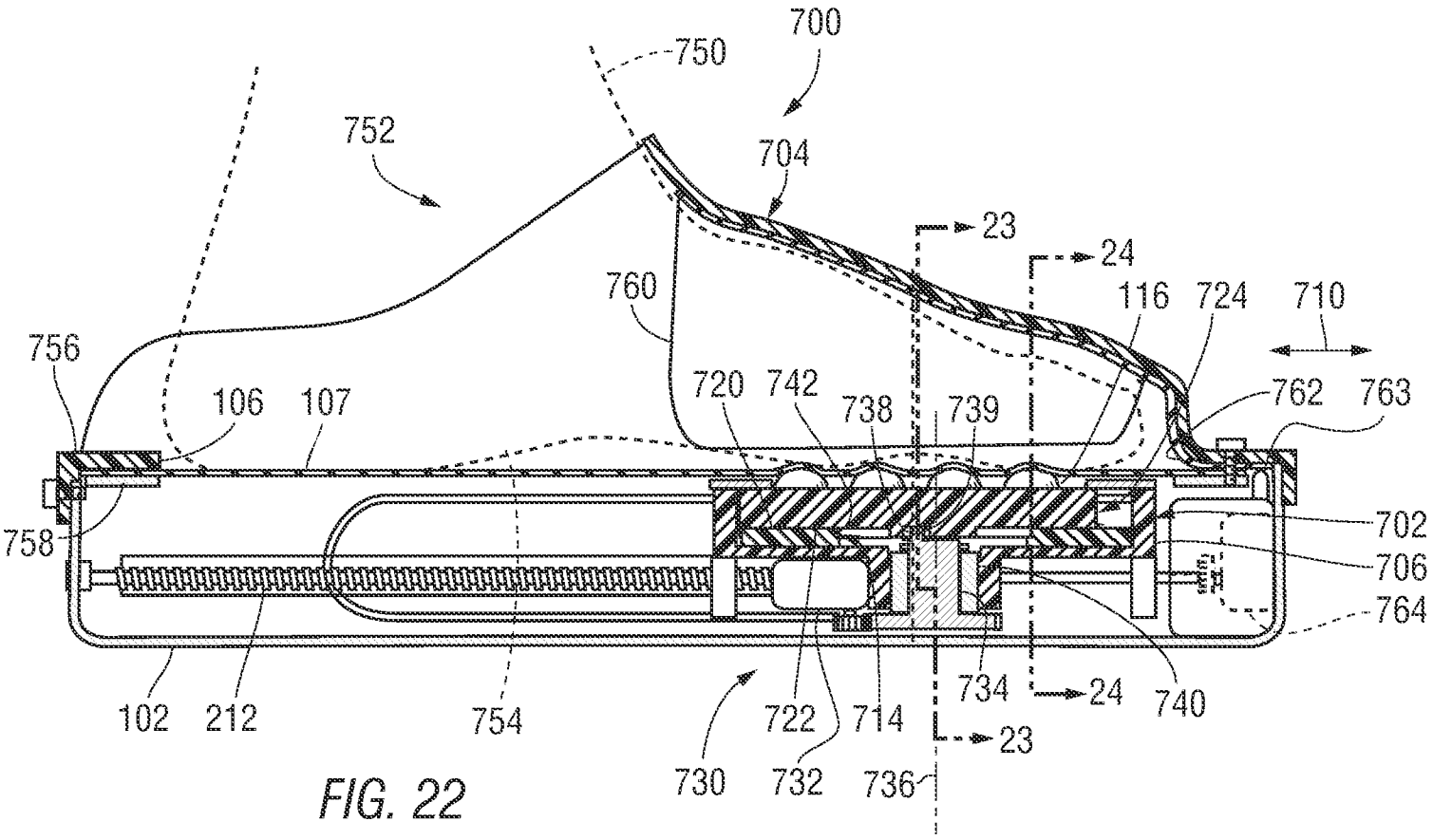
FIG. 22 is a longitudinal cross-sectional elevation of a massage device built in accordance with a first embodiment of the invention.
Figure 25:
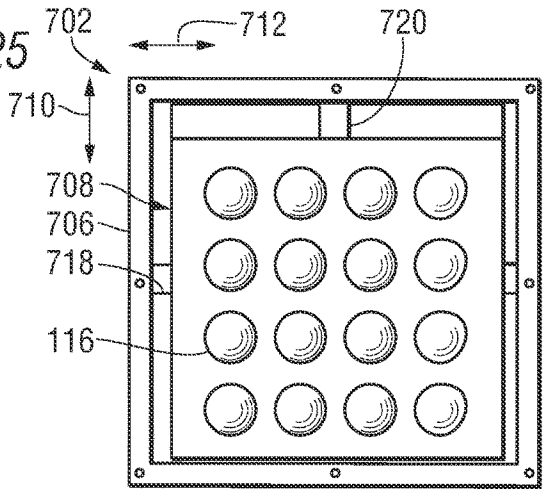
FIG. 25 is a plan view of the carriage of FIG. 24.
Figure 26:
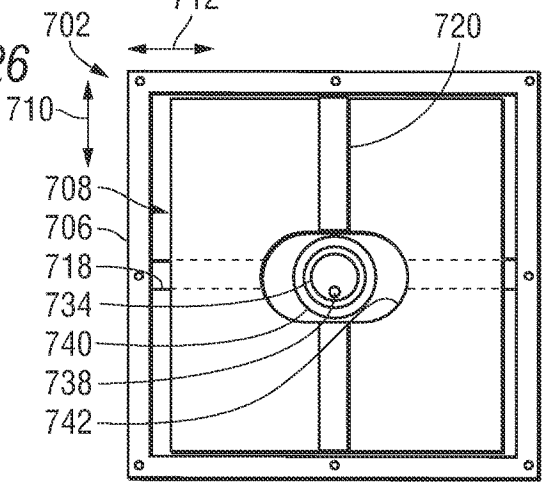
FIG. 26 is a plan view of the carriage of FIG. 24, shown with a massage plate therein removed to reveal underlying structures.
Figure 23:
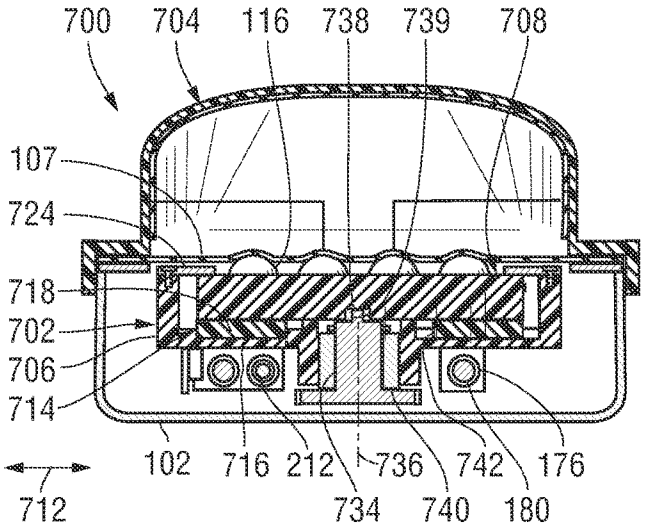
FIG. 23 is a transverse cross-sectional elevation of the massage device of FIG. 22, taken as indicated by section lines 22-22 therein.
Figure 24:
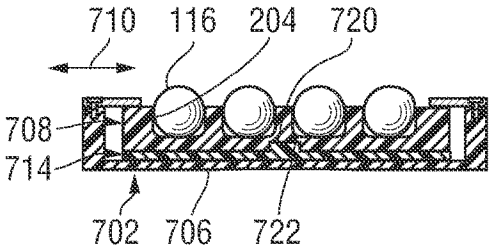
FIG. 24 is a transverse cross-sectional elevation of a carriage within the massage device of FIG. 22, taken as indicated by section lines 23-23 therein.

A massage device 700, built in accordance with a third embodiment of the invention, will now be discussed, with reference initially being made to FIGS. 22 and 23. FIG. 22 is a longitudinal cross-sectional elevation of the massage device 700, while FIG. 23 is a transverse cross-sectional elevation thereof, taken as indicated by section lines 23-23 in FIG. 22. The massage device 700 is similar to the massage device 100, described above in reference to FIGS. 1-5, with similar elements being accorded like reference numbers, except for an alternative carriage 702 and an alternative foot enclosure 704. The alternative carriage 702 includes a carriage housing 706 and a massage plate 708, which is mounted to slide within the carriage housing 706 both in longitudinal directions, as indicated by arrow 710 and in transverse directions, as indicated by arrow 712. Additional views of the alternative carriage 706 are provided by FIGS. 24-26, with FIG. 24 being a transverse cross-sectional elevation thereof, taken as indicated by section lines 24-24 in FIG. 22, and with FIGS. 25 and 26 being plan views thereof. FIG. 25 shows the massage plate 708 within the alternative carriage 702, while FIG. 24 shows the alternative carriage 702 with the massage plate 708 removed from the alternative carriage 702 to reveal underlying structures. The massage plate 708 includes a first plurality of massage elements 116 formed as spherical balls held within sockets 204.

The alternative carriage 702 includes a sliding plate 714, which is mounted to slide in the transverse directions of arrow 712 within the carriage 702 by the engagement of a transverse track 716 extending downward from the sliding plate 714 into an upward-facing groove 718 within the carriage housing 706. The massage plate 708 is mounted to move with the sliding plate 714 in the transverse directions of arrow 712 and to slide on the sliding plate 714 in the longitudinal directions of arrow 710 by the engagement of a longitudinal track 720 extending upward from the sliding plate 714 into a downward-facing groove 722 within the massage plate 708. The alternative carriage 702 additionally includes a frame 724 (not shown in FIGS. 25 and 26) restricting upward movement of the massage plate 708. In this way, rotation of the massage plate 708 is prevented, while the massage plate 708 is allowed to move within the carriage 702 in both the longitudinal directions of arrow 710 and the transverse directions of arrow 712. It is understood that similar results can be obtained by configuring the sliding plate to slide longitudinally within the carriage 702, while the massage plate slides transversely on the sliding plate. The alternative carriage 102 additionally includes a massage plate driving mechanism 730 having a massage plate drive motor 732 driving a drive shaft 734 about a vertical axis 736, with the drive shaft 734 including an eccentric pin 738 displaced from the vertical axis 736, rotatably engaging a hole 739 within the massage plate 708. The drive shaft 734 is rotatably mounted within a bearing 740 to extend upward into an elongated hole 742 within the sliding plate 714.

Continuing to refer to FIGS. 22 and 23, the massage device 700 additionally includes as alternative foot enclosure 704 that extends around a human foot 750, forming a pocket 752 holding the sole 754 of the foot 750 in place adjacent an opening 106 that extends above massage elements within the housing 102 of the massage device 700. The alternative foot enclosure 704 includes a base portion 756 that extends outward to be attached to the housing 102 and a flexible sheet 107 that is attached to the base portion 756 by a frame 758. The alternative foot enclosure 704 further includes a heating element 760 with electrical circuit paths as generally described above in reference to FIG. 3. A distal tab 762 of the heating element 760 includes a number of conductive pads (not shown) contacting pins 763 extending upward from a heater control circuit 764 within the housing 102. The alternate carriage 702 includes a number of bushings 176 sliding along parallel rails 180 within the housing 102 as the alternate carriage 702 is driven in the longitudinal directions of arrow 710 by a leadscrew 212

Figure 27:
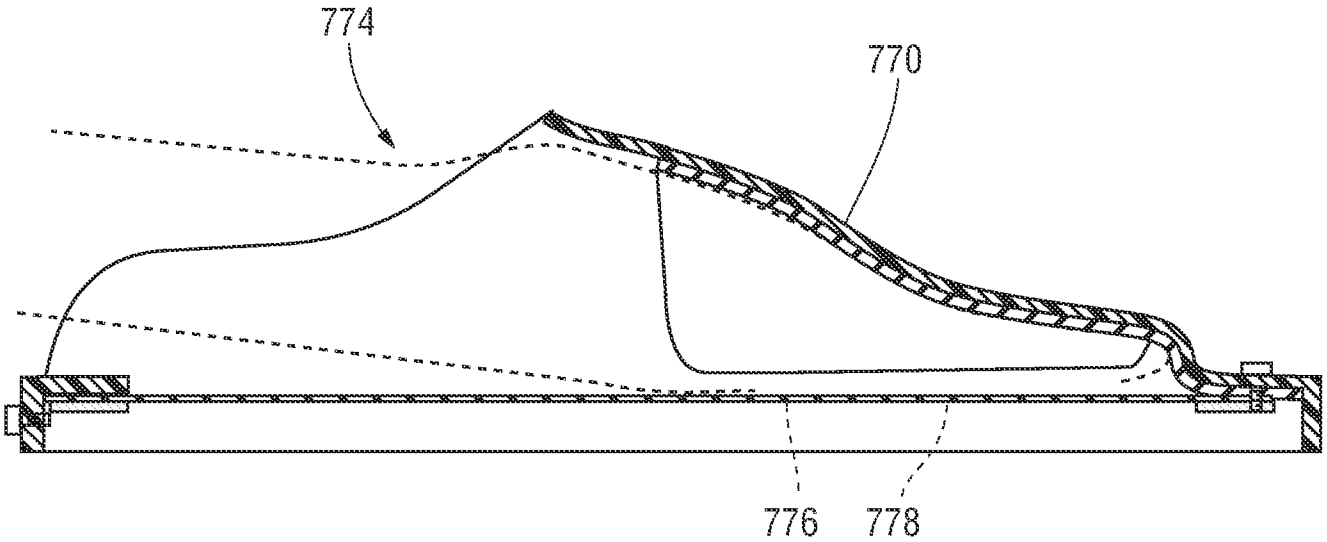
FIG. 27 is a longitudinal cross-sectional view of a hand enclosure configured for alternative attachment to a housing within the massage device of FIG. 22.

FIG. 27 is a longitudinal cross-sectional elevation of an alternative hand enclosure 770 that is extends around a human hand 772, forming a 774 holding the palm 776 of the hand 770 in place with the palm of the hand adjacent the opening 106. Otherwise, the alternative hand enclosure is similar to the alternative hand enclosure 750, which is replaced on the housing 102 to provide a hand massage.

While the invention has been described in terms of preferred versions or embodiments with some degree of particularity, it is understood that this description has been given merely as an example, and that many changes can be made without departing from the scope and spirit of the invention, as described in the appended claims.

What is claimed is:

1. An apparatus for massaging a surface of a human extremity, comprising:

a housing including an upper surface having a housing opening configured to extend around an external surface of the human extremity;

a carriage mounted to move in longitudinal directions within the housing below the housing opening in either direction between a forward position and a backward position;

a carriage drive mechanism moving the carriage longitudinally in either direction between the forward position and the backward position;

a massage plate, including an upper surface having a plurality of sockets holding spherical balls forming a first plurality of message elements;

a sliding plate mounted to slide within the carriage in a first direction and constrained to slide within the carriage without rotation in the first direction, wherein the massage plate is mounted to slide on the sliding plate in a second direction and constrained to slide on the sliding plate without rotation in the second direction;

a massage plate driving mechanism including a massage plate drive motor, a drive shaft driven in rotation about a vertical axis, and an eccentric pin, attached to the drive shaft and spaced apart from the vertical axis, wherein the eccentric pin is mounted to rotate within the massage plate.

2. The apparatus of claim 1, additionally comprising a flexible sheet held in place within the housing by a frame to extend across the housing opening.

3. The apparatus of claim 1, wherein the carriage drive mechanism additionally comprises:

a carriage drive motor moving the carriage longitudinally; and a location sensing device turning the carriage drive motor off to stop forward motion of the carriage when the carriage has reached the forward position and to stop backward motion of the carriage with the carriage has reached the backward position.

4. The apparatus of claim 1, additionally comprising a pair of rails extending within the housing and a plurality of bushings attached to the carriage, wherein the carriage is mounted to move longitudinally within the housing by sliding engagement between the bushings and the rails, and wherein the carriage drive mechanism includes:

a leadscrew, driven in rotation by the carriage drive motor and extending within the housing to drive the carriage between the forward and backward positions;

a nut attached to the carriage, engaging the leadscrew.

5. The apparatus of claim 1, additionally comprising a first upper cover attached to the housing, including a flexible strap configured to form a pocket holding a sole of a human foot adjacent a portion of the housing opening.

6. The apparatus of claim 5, wherein the first upper cover additionally comprises a heating element.

7. The apparatus of claim 1, wherein the sliding plate slides along the carriage with a track from the sliding plate extending within a groove in the carriage, and the massage plate slides along the sliding plate with a track from the massage plate extending within a groove in the sliding plate.

8. The apparatus of claim 1, wherein the second direction is the longitudinal direction, and the first direction is a transverse direction, wherein the first direction is perpendicular relative to the second direction.

9. The apparatus of claim 8, wherein the number of massage elements in each row is equal to the number of rows in the plurality of message elements.

* * * * *